US007261583B2

(12) United States Patent
Ikeya et al.

(10) Patent No.: US 7,261,583 B2
(45) Date of Patent: Aug. 28, 2007

(54) CONNECTOR SET WITH A LOCKING DEVICE

(75) Inventors: Kenichi Ikeya, Shizuoka-ken (JP); Yasuhiro Sasaki, Shizuoka-ken (JP); Shigeru Tanaka, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 85 days.

(21) Appl. No.: 11/214,970

(22) Filed: Aug. 31, 2005

(65) Prior Publication Data

US 2006/0046551 A1 Mar. 2, 2006

(30) Foreign Application Priority Data

Sep. 1, 2004 (JP) ..... 2004-254499

(51) Int. Cl.
*H01R 13/627* (2006.01)

(52) U.S. Cl. ..... 439/357

(58) Field of Classification Search ..... 439/357, 439/358, 354

See application file for complete search history.

(56) References Cited

U.S. PATENT DOCUMENTS

| | | | | |
|---|---|---|---|---|
| 4,915,643 | A | 4/1990 | Samejima et al. | |
| 4,986,766 | A * | 1/1991 | Leonard et al. | 439/352 |
| 5,496,190 | A * | 3/1996 | Ittah et al. | 439/354 |
| 7,029,311 | B2 * | 4/2006 | Peloza | 439/357 |
| 2003/0049962 | A1 | 3/2003 | Raudenbush et al. | |
| 2004/0053531 | A1 | 3/2004 | Annequin | |

FOREIGN PATENT DOCUMENTS

| | | |
|---|---|---|
| DE | 195 02 387 A1 | 8/1995 |
| EP | 1 408 589 A1 | 7/2003 |
| JP | 2003-142209 | 5/2003 |

OTHER PUBLICATIONS

European Search Report.

* cited by examiner

*Primary Examiner*—Hae Moon Hyeon
(74) *Attorney, Agent, or Firm*—Finnegan, Henderson, Farabow, Garrett & Dunner, L.L.P.

(57) ABSTRACT

A connector set is provided with a first member including a locking device having a proximal portion formed as a protrusion ranging in parallel with an axis of the first member, a resilient beam extending from the proximal portion and being elastically deformable along the proximal portion, and a locking projection projecting from the resilient beam; and a second member configured to receive the first member in a direction of the axis of the first member, the second member including an engaging portion configured to latch the locking projection.

7 Claims, 4 Drawing Sheets

CONNECTOR SET WITH A LOCKING DEVICE

BACKGROUND OF THE INVENTION

1. Field of the Invention

The present invention relates to a connector set applied to electrical connection between electrical terminals.

2. Description of the Related Art

Various connectors in practical use are provided with locking means for preserving a locking state. A combination of a resilient arm with a locking projection and a stopper for engaging with the locking projection is exemplified as the locking means. The resilient arm is in general formed as sort of a cantilever and projects rearward and oblique to an axis of the connector so as to smoothly deform in accordance with insertion movement of the connector.

SUMMARY OF THE INVENTION

According to such connectors of prior arts, in the course of insertion movement of the connector, a degree of deformation of the resilient arm increases depending on progress of the insertion. Thereby the insertion must be accomplished against increasing repulsive force.

The present invention is achieved in view of the above problem and is intended for providing a connector set, repulsive force of which is kept substantially constant throughout the insertion.

According to an aspect of the present invention, a connector set is provided with a first member including a locking device having a proximal portion formed as a protrusion ranging in parallel with an axis of the first member, a resilient beam extending from the proximal portion and being elastically swingingly deformable along the proximal portion, and a locking projection projecting from the resilient beam; and a second member configured to receive the first member in a direction of the axis of the first member, the second member including an engaging portion configured to latch the locking projection.

Preferably, the locking device is provided with means for regulating repulsive force of the locking device. More preferably, a front end of the locking device includes a chamfered bevel. Further preferably, the means for regulating repulsive force of the locking device is a slit formed at a rear end of the locking device, the slit partially separating the proximal portion and the resilient beam. Still preferably, the means for regulating repulsive force of the locking device is a slit separating the proximal portion and the resilient beam around a rear end of the locking device. Alternatively preferably, the means for regulating repulsive force of the locking device is a slot formed around the locking projection. Further preferably, the second member is configured to house the first member. Still further preferably, the resilient beam is repulsively supported in an inner surface of the second member.

DETAILED DESCRIPTION OF THE PREFERRED EMBODIMENT

Figure 1:
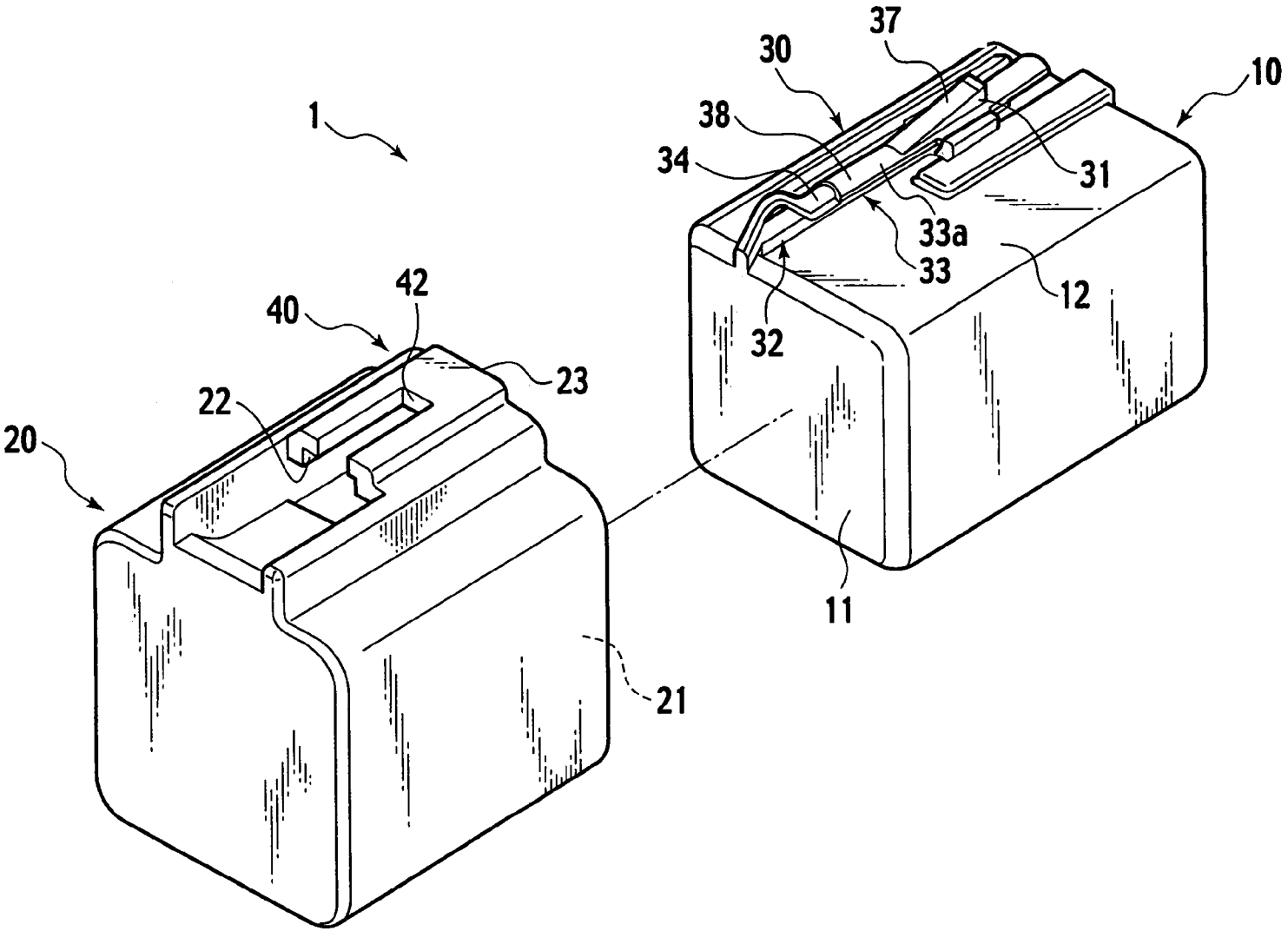
FIG. 1 is an exploded perspective view of a connector set in accordance with an embodiment of the present invention.
Figure 2:
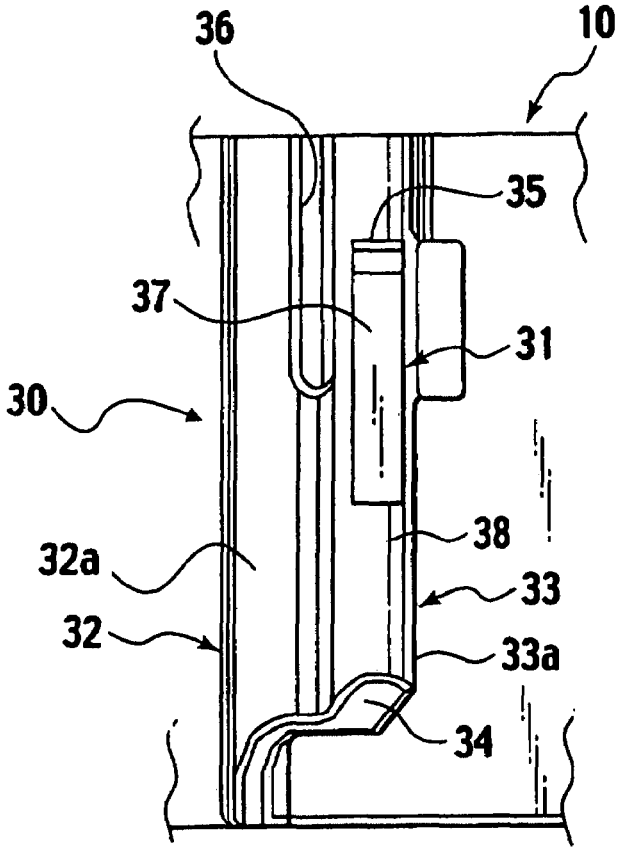
FIG. 2 is a top view of a first connector housing and a locking device of the connector.
Figure 3:
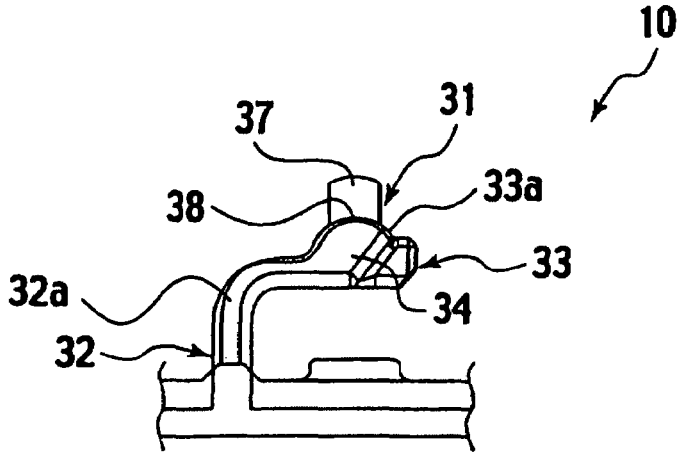
FIG. 3 is a front view of the locking device.
Figure 4:
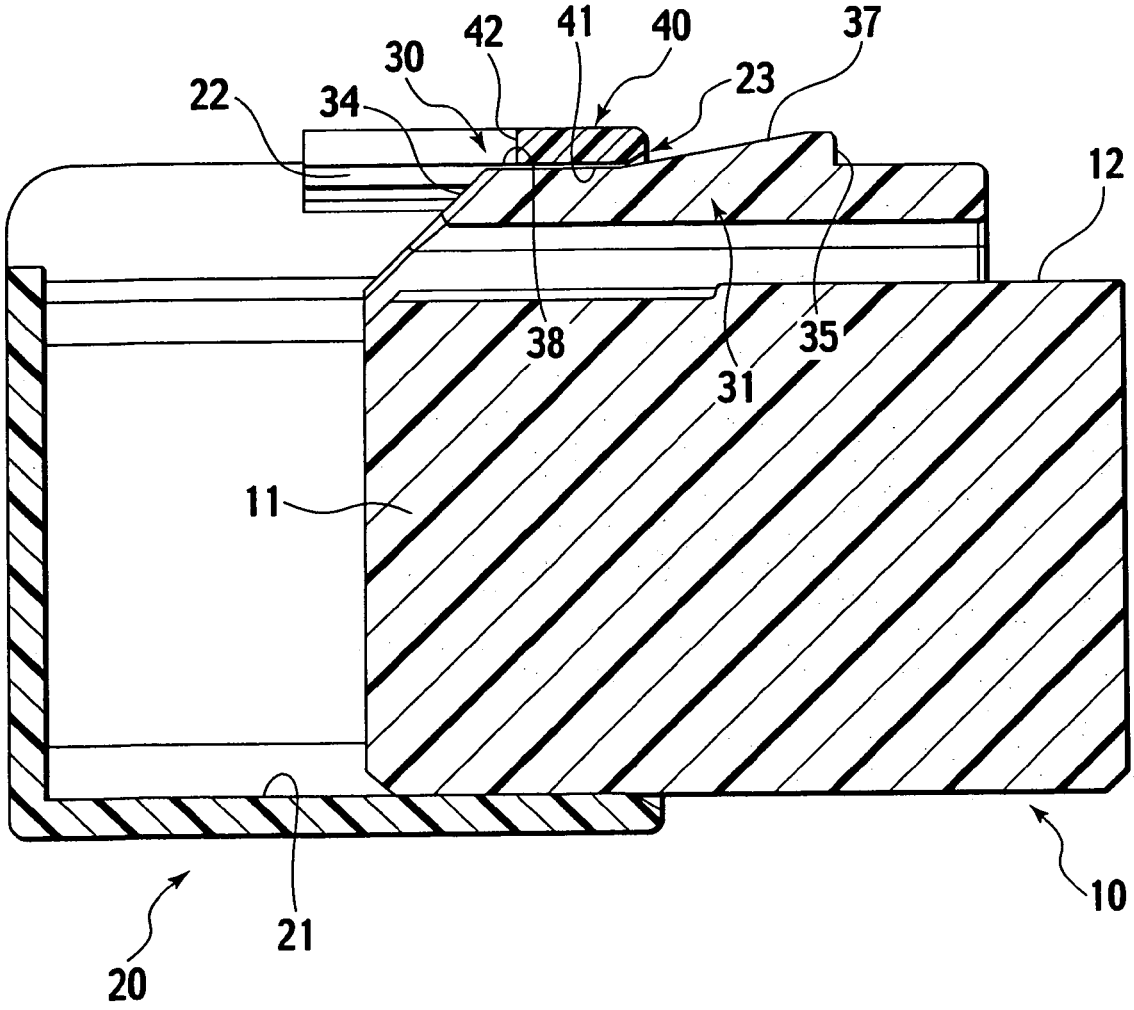
FIG. 4 is a sectional view of the connector set under a connection process.
Figure 5:
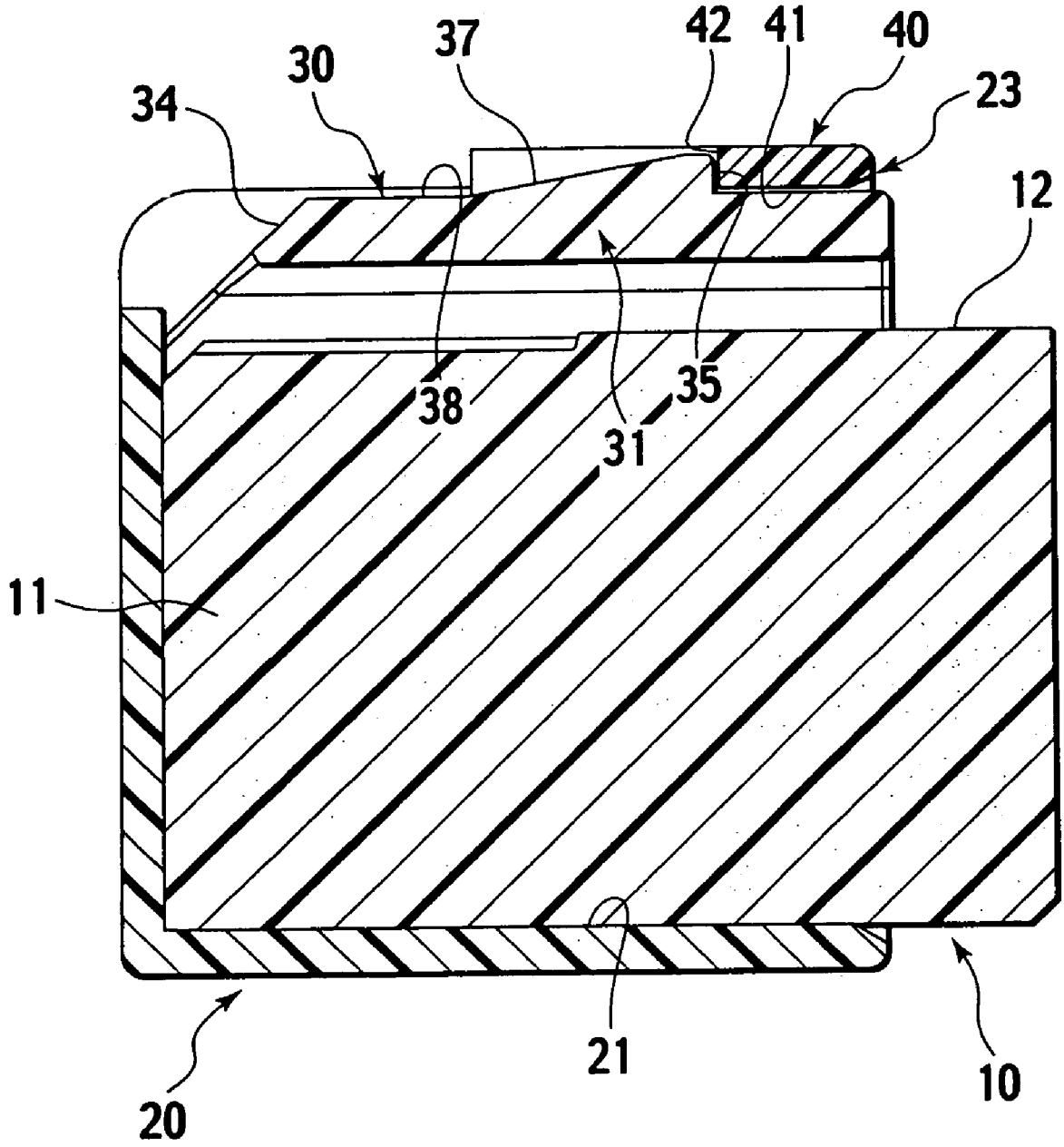
FIG. 5 is a sectional view of the connector set in a connection state.

An embodiment of the present invention will be described hereinafter with reference to FIGS. 1 through 5. Throughout the specification and claims, front and rear are defined in accordance with a direction where a first connector housing 10 is inserted into a second connector housing 20.

As shown in FIGS. 1 through 5, a connector set 1 in accordance with the present embodiment is provided with a first connector housing 10 and a second connector housing 20. The second connector housing 20 is configured to house the first connector housing 10. When the first connector housing 10 and the second connector housing 20 are engaged, terminals (not shown) housed therein are mutually connected. Terminal housings 11 and 21 are respectively formed at substantially central portions of the connector housings 10 and 20. The terminal housing 21 is formed so as to receive the terminal housing 11. When the terminal housing 21 receives the terminal housing 11, the terminals housed therein are mutually connected.

A top wall 12 of the first connector housing 10 is provided with a locking device 30. The locking device 30 is provided with a locking projection 31 around a distal end thereof, which is configured to engage with and disengage from an engaging portion 40 of the second connector housing 20. When the first connector housing 10 is inserted in the second connector housing 20, the locking projection 31 latches the engaging portion 40 so as to preserve a connection state between the first connector housings 10 and 20.

The locking projection 31 is further configured to be capable of disengaging from the engaging portion 40 so that a user can extract the first connector housing 10 out of the second connector housing 20.

The locking device 30 is made of any resilient material and formed in a unitary body with the first connector housing 10. The locking device 30 ranges along the top wall 12 of the first connector housing 10 in parallel with an axis thereof along which the first connector housing 10 is inserted in and extracted from the second connector housing 20. The locking device 30 is composed of a proximal portion 32 formed as a protrusion ranging along the top wall 12 and a resilient beam 33 bending from the proximal portion 32 about a resilient connection 32*a* with the proximal portion. The resilient connection 32*a* extends in a direction generally parallel to the axis of the connector housing 10 as illustrated, for example, in FIG. 2, and over-hanging the top wall 12. The resilient beam 33 is provided with a rib 33*a* projecting therefrom, on which the locking projection 31 is projectingly formed. Because of resilience, the locking device 30 is elastically inwardly deformable along the proximal portion 32 and outwardly repulsive toward an inner surface, namely a sliding surface 22, of the second connector housing 20 when the first connector housing 10 is connected with the second connector housing 20.

A front end of the locking device 30 has a chamfered bevel 34, which slips onto an inner surface 41 of the engaging portion 40 in the course of insertion of the first connector housing 10 into the second connector housing 20. A rear end of the locking device 30 has a slit 36 as means for regulating repulsive force of the locking device 30, which partially separates the proximal portion 32 and the resilient beam 33 and hence allows the rear portion of the locking device 30 to further inwardly deform.

The engaging portion 40 is formed on an open end 23, into which the first connector housing 10 is inserted, of the second connector housing 20. The engaging portion 40 spans and is supported by right and left sides of the open end 23. The engaging portion 40 is provided with an engaging surface 42 as opposed to the open end 23, which a locking surface 35 of the locking projection 31 latches when the first connector housing 10 is connected to the second connector housing 20. Thereby the first connect housing 10 and the second connector housing 20 are preserved in the connection state and prevented from displacing.

The first connector housing 10 and the second connector housing 20 come into the connection state in a manner as described hereinafter. As shown in FIGS. 1 through 5, a front end of the terminal housing 11 of the first connector housing 10 is first inserted into the terminal housing 21 of the second connector housing 20. In this occasion, the locking device 30 elastically deforms and abuts the inner surface 41 of the engaging portion 40 to slip therein.

When the terminal housing 11 is further inserted into the terminal housing 21, the locking device 30 further deforms around the slit 36. Further a contact spot where the locking device 30 touches the inner surface 41 of the engaging portion 40 moves from the chamfered bevel 34 toward a sliding slope 37 of the locking projection 31. When the terminal housing 11 is further inserted, the inner surface 41 gets over the locking projection 31. Accompanying this movement, any excessive force is not necessary because the slit 36 allows partial deformation of the locking device 30. Then, the engaging surface 42 of the engaging portion 40 latches the locking projection 31.

After the locking projection 31 latches the engaging surface 42, the repulsive force of the locking device 30 preserves a rib sliding portion 38 to be repulsively supported in the inner surface 41.

In accordance with the present embodiment described hereinbefore, the locking device 30 ranges in parallel with the axis along which the first connector housing 10 is inserted into the second connector housing 20 so as to deform perpendicularly to the axis about resilient connection 32*a*. A degree of deformation of the locking device 30 does not change so much depending on progress of the insertion of the first connector housing 10. Thereby, force for the insertion against the repulsive force of the locking device 30 is kept substantially constant throughout the insertion.

Instead of providing the locking device 30 with the slit 36, slots around the locking projection 31 may be formed as means for regulating repulsive force of the locking device 30. This provides a similar effect to the above embodiment.

Although the invention has been described above by reference to an embodiment of the invention, the invention is not limited to the embodiment described above. Modifications and variations of the embodiment described above will occur to those skilled in the art, in light of the above teachings.

What is claimed is:

1. A connector set comprising:

a first member including a locking device having a proximal portion formed as a protrusion ranging in parallel with an axis of the first member, a resilient beam extending from the proximal portion and overhanging a wall of the first member, the resilient beam being elastically deformable about a resilient connection to the proximal portion, the resilient connection extending in a direction generally parallel to the axis of the first member, and a locking projection projecting from the resilient beam; and a second member configured to receive the first member in a direction of the axis of the first member, the second member including an engaging portion configured to latch the locking projection.

2. The connector set of claim 1, wherein the locking device includes means for regulating repulsive force of the locking device.

3. The connector set of claim 1, wherein a front end of the locking device includes a chamfered bevel.

4. The connector set of claim 2, wherein the means for regulating repulsive force on the locking device is a slit formed at a rear end of the locking device, the slit partially separating the proximal portion and the resilient beam.

5. The connector set of claim 2, wherein the means for regulating repulsive force of the locking device is a slot formed around the locking projection.

6. The connector set of claim 1, wherein the second member is configured to house the first member.

7. The connector set of claim 6, wherein the resilient beam is repulsively supported in an inner surface of the second member.

* * * * *